US010220429B2

(12) United States Patent
Haulsee

(10) Patent No.: US 10,220,429 B2
(45) **Date of Patent: *Mar. 5, 2019**

(54) ACTUATOR WITH VARIABLE SPEED SERVO MOTOR FOR REDRAW ASSEMBLY

(71) Applicant: Stolle Machinery Company, LLC, Centennial, CO (US)

(72) Inventor: Donald Ray Haulsee, Claremont, VA (US)

(73) Assignee: Stolle Machinery Company, LLC, Centennial, CO (US)

( * ) Notice: Subject to any disclaimer, the term of this patent is extended or adjusted under 35 U.S.C. 154(b) by 405 days.

This patent is subject to a terminal disclaimer.

(21) Appl. No.: 15/016,347

(22) Filed: Feb. 5, 2016

(65) Prior Publication Data

US 2016/0151823 A1 Jun. 2, 2016

Related U.S. Application Data

(63) Continuation of application No. 14/023,491, filed on Sep. 11, 2013, now Pat. No. 9,352,375.

(51) Int. Cl.

| | |
|---|---|
| ***B21D 51/26*** | (2006.01) |
| ***B21D 22/28*** | (2006.01) |
| ***B30B 1/06*** | (2006.01) |
| ***B30B 1/26*** | (2006.01) |

(52) U.S. Cl.

CPC ..... *B21D 22/28* (2013.01); *B21D 51/26* (2013.01); *B30B 1/06* (2013.01); *B30B 1/268* (2013.01)

(58) Field of Classification Search

CPC .... B21D 22/28; B21D 51/26; B21D 51/2692; B30B 1/06; B30B 1/26; B30B 1/263; B30B 1/266; B30B 15/14; B30B 15/144; B30B 15/148; B30B 15/26; F16H 21/18

See application file for complete search history.

(56) References Cited

U.S. PATENT DOCUMENTS

| | | | |
|---|---|---|---|
| 3,696,657 | A | 10/1972 | Maytab |
| 3,751,962 | A | 8/1973 | Cvacho et al. |
| 3,786,667 | A | 1/1974 | Garnett, Jr. |
| 3,850,123 | A | 11/1974 | LaRocca et al. |

(Continued)

FOREIGN PATENT DOCUMENTS

| | | |
|---|---|---|
| CN | 202427791 | 9/2012 |
| EP | 3053668 | 8/2016 |
| WO | 2010/064432 | 10/2010 |

OTHER PUBLICATIONS

Wikipedia defintion of servomotor, retreived from website, Aug. 31, 2018.*

(Continued)

*Primary Examiner* — Edward Tolan

(74) *Attorney, Agent, or Firm* — Eckert Seamans Cherin & Mellott, LLC; David C. Jenkins

(57) ABSTRACT

An actuator assembly for a redraw sleeve that operates independently of the ram drive mechanism is provided. The actuator assembly utilizes an eccentric journal coupled to a drive shaft of a servomotor. The servomotor is structured to provide its output shaft with a variable rotation speed so as to accommodate the need for the redraw sleeve to be in selected locations at specific times. Further, the redraw sleeve includes a collapsing redraw cylinder to allow the redraw sleeve to dwell in a forward position.

20 Claims, 8 Drawing Sheets

(56) References Cited

U.S. PATENT DOCUMENTS

| | | | | |
|---|---|---|---|---|
| 4,020,670 | A | 5/1977 | Bulso, Jr. et al. | |
| 4,581,915 | A | 4/1986 | Haulsee et al. | |
| 4,702,098 | A | 10/1987 | Pora et al. | |
| 4,934,167 | A | 6/1990 | Grims et al. | |
| 4,996,865 | A * | 3/1991 | Haulsee | B21D 22/28 72/349 |
| 5,257,523 | A | 11/1993 | Hahn et al. | |
| 5,271,259 | A | 12/1993 | Miller et al. | |
| 5,357,779 | A | 10/1994 | Hahn et al. | |
| 5,454,254 | A | 10/1995 | Mueller | |
| 5,546,785 | A | 8/1996 | Platt et al. | |
| 5,572,891 | A | 11/1996 | Klein et al. | |
| 5,775,160 | A | 7/1998 | Fleischer et al. | |
| 7,434,442 | B2 | 10/2008 | Gombas | |
| 7,882,721 | B2 | 2/2011 | Gombas | |
| 8,997,544 | B2 | 4/2015 | Abt et al. | |
| 2008/0028817 | A1 * | 2/2008 | Ribordy | B21D 22/30 72/347 |
| 2008/0041133 | A1 | 2/2008 | Gombas | |
| 2013/0333437 | A1 * | 12/2013 | Schollhammer | B21D 22/22 72/347 |
| 2014/0311206 | A1 * | 10/2014 | Berring | B21D 45/04 72/346 |

OTHER PUBLICATIONS

Stolle Machinery Company, LLC, EP 14844346.8 EP Search Report, dated Mar. 17, 2016, 7 pages.

* cited by examiner

ACTUATOR WITH VARIABLE SPEED SERVO MOTOR FOR REDRAW ASSEMBLY

CROSS REFERENCE TO RELATED APPLICATION

This application is a continuation patent application of U.S. patent application Ser. No. 14/023,491, filed Sep. 11, 2013, entitled ACTUATOR WITH VARIABLE SPEED SERVO MOTOR FOR REDRAW ASSEMBLY.

BACKGROUND OF THE INVENTION

Field of the Invention

The disclosed concept relates generally to a can bodymaker and, more specifically, to a can bodymaker having a redraw assembly actuated by an eccentric journal.

Background Information

Generally, an aluminum can begins as a disk of aluminum, also known as a "blank," that is punched from a sheet or coil of aluminum. The blank is fed into a cupper. The cupper performs a blank and draw process to create a cup. That is, the blank is formed into a cup having a bottom and a depending sidewall. The cup is fed into one of several bodymakers, which perform a redraw and ironing operation. More specifically, the cup is disposed in a can forming machine at the mouth of a die pack having substantially circular openings therein. The cup is held in place by a redraw sleeve, which is part of the redraw assembly. The redraw sleeve is a hollow tubular construct that is disposed inside the cup and biases the cup against the die pack. More specifically, the first die in the die pack is the redraw die, which is also a part of the redraw assembly. The cup is biased against the redraw die by the redraw sleeve. Other dies, the ironing dies, are disposed behind, and axially aligned with, the redraw die. The ironing dies are not part of the redraw assembly. An elongated, cylindrical ram having a punch at the forward, distal end is aligned with, and structured to travel through, the openings in the redraw die and the ironing dies. At the end of the die pack opposite the ram is a domer. The domer is a die structured to form a concave dome in the bottom of the cup/can.

Thus, in operation, a cup is disposed at one end of the die pack. The cup, typically, has a greater diameter than a finished can as well as a greater wall thickness. The redraw sleeve is disposed inside of the cup and biases the cup bottom against the redraw die. The opening in the redraw die has a diameter that is smaller than the cup. The ram, with the punch as the forward, distal end, passes through the hollow redraw sleeve and contacts the bottom of the cup. As the ram continues to move forward, the cup is moved through the redraw die. As the opening in the redraw die is smaller than the original diameter of the cup, the cup is deformed and becomes elongated with a smaller diameter. The wall thickness of the cup typically remains the same as the cup passes through the redraw die. As the ram continues to move forward, the elongated cup passes through a number of ironing dies. The ironing dies each thin the wall thickness of the cup causing the cup to elongate. The final forming of the can body occurs when the bottom of the elongated cup engages the domer, creating a concave dome in the cup bottom. At this point, and compared to the original shape of the cup, the can body is elongated, has a thinner wall, and a domed bottom. The can body is ejected from the ram, and more specifically the punch, for further processing, such as, but not limited to trimming, washing, printing, flanged, inspected and placed on pallets, which are shipped to the filler. At the filler, the cans are taken off of the pallets, filled, ends placed on them and then the filled cans are repackage in six packs and/or twelve packs cases etc.

The ram moves in a cycle many times each minute. Thus, for each cycle, a cup must be positioned in front of the die pack and clamped by the redraw sleeve. That is, as noted above, the redraw assembly includes the stationary redraw die and the movable redraw sleeve. The redraw sleeve must move forward and back for each cycle. Moreover, the redraw sleeve must "dwell" in the forward location, i.e., clamping the cup, while the ram passes therethrough and moves the cup into the redraw die. That is, the motion of the redraw sleeve includes a forward motion, a dwell, and a backward motion. The redraw sleeve is, typically, moved by a circular cam disposed about the redraw sleeve. The circular cam is a continuous ridge extending inwardly from an outer sleeve, or "outer casing," disposed about a carrier for the redraw sleeve. The cam, i.e., the continuous ridge, encircles the inner surface of the outer sleeve with portions that are angled forward, not angled (or not substantially angled), and angled backward. The carrier for the redraw sleeve has a cam follower. As the outer sleeve rotates, different portions of the cam engage the cam followers.

Thus, as the portion of the cam that is angled forward engages the cam followers, the redraw sleeve carrier, and thus the redraw sleeve, moves forward; this is the motion that moves the redraw sleeve into the cup and biases the cup against the redraw die. At this point, a non-angled portion of the cam engages the cam followers; this causes the redraw sleeve to dwell in the forward position, i.e., clamping the cup. Continued rotation of the redraw sleeve carrier causes the angled backward portions of the cam to engage the cam followers and the redraw sleeve carrier, and thus the redraw sleeve, moves forward. It is noted that the backward motion of the redraw sleeve occurs, essentially, as soon as the cup is moved into the redraw die and while the ram is extending through the redraw sleeve. Once the ram is withdrawn from the redraw sleeve, a new cup is moved into position in front of the redraw die and the cycle begins again. A device that performs these operations is disclosed in U.S. Pat. No. 5,775,160, which is incorporated by reference.

The outer sleeve upon which the cam is disposed is heavy. This sleeve is actuated by cams, or other mechanical links, that are coupled to the drive mechanism for the ram. In this manner, the motion for the redraw sleeve is linked to the motion of the ram. The components forming the linkage between the ram drive mechanism and the cam must be robust, including being heavy, in order to accommodate the multiple cycles that occur every minute. Because the outer sleeve and other linkage components are heavy, the drive mechanism for the ram must be structured to provide more energy than is required to simply move the ram. Further, all the mechanical linkages from the ram drive mechanism to the redraw sleeve are prone to wear and tear. There is, therefore, a need for an improved actuator for a redraw sleeve.

SUMMARY OF THE INVENTION

The disclosed and claimed device provides for an actuator for a redraw sleeve that operates independently of the ram drive mechanism. The actuator utilizes an eccentric journal coupled to a drive shaft of a servomotor. The servomotor is structured to provide its output shaft with a variable rotation speed so as to accommodate the need for the redraw sleeve to be in selected locations at specific times. Further, the redraw sleeve includes a collapsing redraw cylinder to allow the redraw sleeve to dwell in a forward position.

BRIEF DESCRIPTION OF THE DRAWINGS

A full understanding of the invention can be gained from the following description of the preferred embodiments when read in conjunction with the accompanying drawings in which:

In FIG. 6, the eccentric journal is in a first, rearward position, or 3:00 o'clock position. In FIG. 7, the eccentric journal is in a medial position, or 6:00 o'clock position. In FIG. 8, the eccentric journal is in a second, forward position, or 9:00 o'clock position. In FIG. 9, the eccentric journal is in another medial position, or 12:00 o'clock position.

DESCRIPTION OF THE PREFERRED EMBODIMENTS

Figure 1:
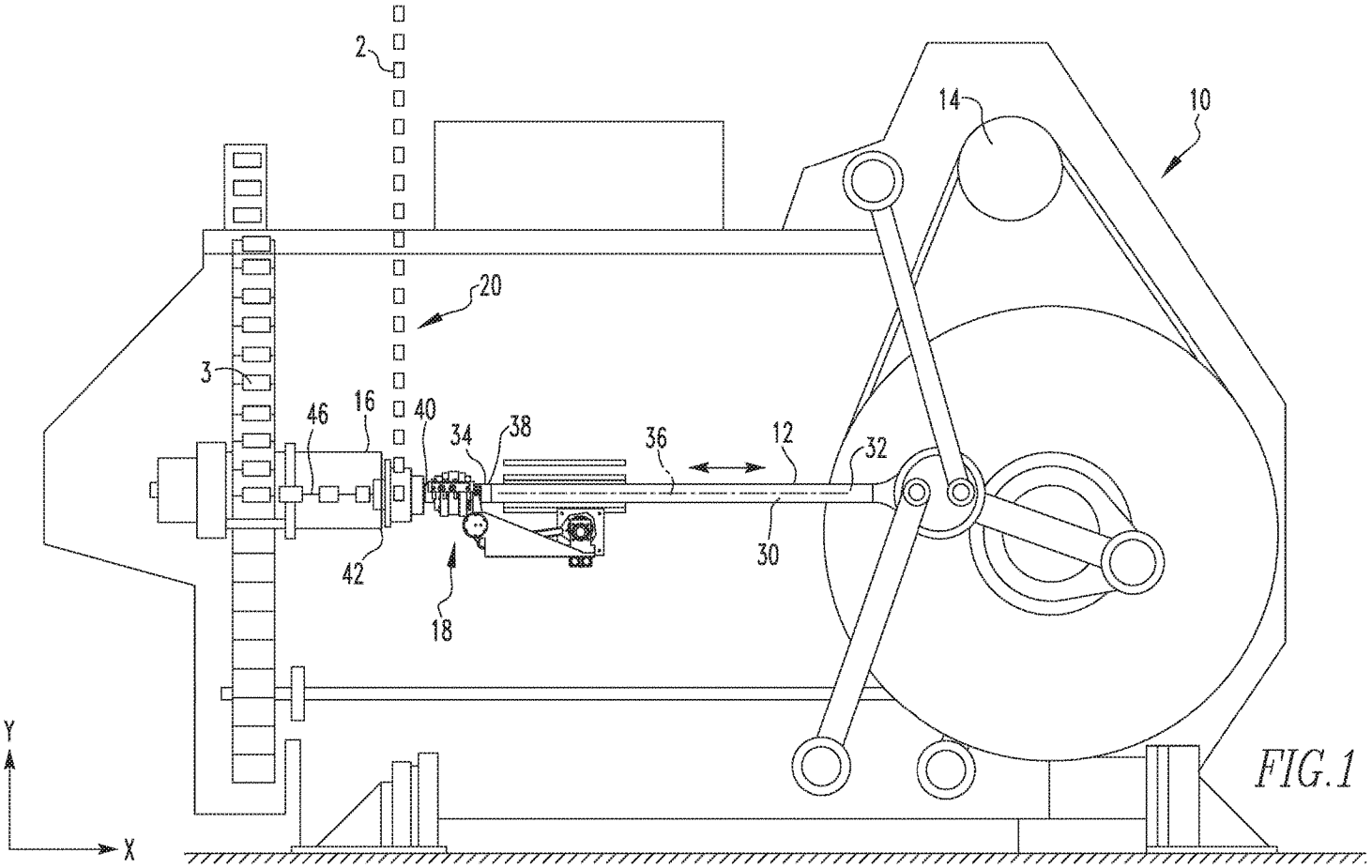
FIG. 1 is side view of a bodymaker.

Directional phrases used herein, such as, for example, clockwise, counterclockwise, left, right, top, bottom, upwards, downwards and derivatives thereof, relate to the orientation of the elements shown in the drawings and are not limiting upon the claims unless expressly recited therein.

As used herein, the singular form of "a," "an," and "the" include plural references unless the context clearly dictates otherwise.

As used herein, the statement that two or more parts or components are "coupled" shall mean that the parts are joined or operate together either directly or indirectly, i.e., through one or more intermediate parts or components, so long as a link occurs. As used herein, "directly coupled" means that two elements are directly in contact with each other. As used herein, "fixedly coupled" or "fixed" means that two components are coupled so as to move as one while maintaining a constant orientation relative to each other. Further, an object resting on another object held in place only by gravity is not "coupled" to the lower object unless the upper object is otherwise maintained substantially in place. That is, for example, a book on a table is not coupled thereto, but a book glued to a table is coupled thereto. Accordingly, when two elements are coupled, all portions of those elements are coupled. A description, however, of a specific portion of a first element being coupled to a second element, e.g., an axle first end being coupled to a first wheel, means that the specific portion of the first element is disposed closer to the second element than the other portions thereof.

As used herein, "engage," when used in reference to gears or other components having teeth, means that the teeth of the gears interface with each other and the rotation of one gear causes the other gear to rotate as well. When used in reference to components other than gears, "engage" means that two or more parts or components exert a force or bias against one another either directly or through one or more intermediate elements or components.

As used herein, the word "unitary" means a component is created as a single piece or unit. That is, a component that includes pieces that are created separately and then coupled together as a unit is not a "unitary" component or body.

As used herein, the term "number" shall mean one or an integer greater than one (i.e., a plurality).

As used herein, a "coupling assembly" includes two or more couplings or coupling components. The components of a coupling or coupling assembly are generally not part of the same element or other component. As such, the components of a "coupling assembly" may not be described at the same time in the following description.

As used herein, a "coupling" or "coupling component(s)" is one or more component(s) of a coupling assembly. That is, a coupling assembly includes at least two components that are structured to be coupled together. It is understood that the components of a coupling assembly are compatible with each other. For example, in a coupling assembly, if one coupling component is a snap socket, the other coupling component is a snap plug, or, if one coupling component is a bolt, then the other coupling component is a nut.

As used herein, "associated" means that the elements are part of the same assembly and/or operate together, or, act upon/with each other in some manner. For example, an automobile has four tires and four hub caps. While all the elements are coupled as part of the automobile, it is understood that each hubcap is "associated" with a specific tire.

As used herein, "correspond" indicates that two structural components are sized and shaped to be similar to each other and may be coupled with a minimum amount of friction. Thus, an opening which "corresponds" to a member is sized slightly larger than the member so that the member may pass through the opening with a minimum amount of friction. This definition is modified if the two components are said to fit "snugly" together or "snugly correspond." In that situation, the difference between the size of the components is even smaller whereby the amount of friction increases. If the element defining the opening and/or the component inserted into the opening are made from a deformable or compressible material, the opening may even be slightly smaller than the component being inserted into the opening. This definition is further modified if the two components are said to "substantially correspond." "Substantially correspond" means that the size of the opening is very close to the size of the element inserted therein; that is, not so close as to cause substantial friction, as with a snug fit, but with more contact and friction than a "corresponding fit," i.e., a "slightly larger" fit. Further, with regard to a surface formed by two or more elements, a "corresponding" shape means that surface features, e.g., curvature, are similar.

As used herein, "structured to [verb]" means that the identified element or assembly has a structure that is shaped, sized, disposed, coupled and/or configured to perform the identified verb. For example, a member that is "structured to move" is movably coupled to another element and includes elements that cause the member to move or the member is otherwise configured to move in response to other elements or assemblies.

As shown in FIG. 1, a can body maker 10 is structured to convert a cup 2 into a can body 3. As described below, the cup 2 is assumed to be substantially circular. It is understood, however, that the cup 2, as well as the resulting can body 3 and elements that interact with the cup 2 or can body 3, may have a shape other than substantially circular. A cup 2 has a bottom member with a depending sidewall defining a substantially enclosed space (none shown). The end of the cup 2 opposite the bottom is open. The can body maker 10 includes a reciprocating ram 12, a drive mechanism 14, a die pack 16, a redraw assembly 18 and a cup feeder 20 (shown schematically). As is known, in each cycle the cup feeder 20 positions a cup 2 in front of the die pack 16 with the open end facing the ram 12. When the cup 2 is in position in front of the die pack 16, a redraw sleeve 40, described below, biases the cup 2 against a redraw die 42, described below. The ram 12 has an elongated, substantially circular body 30 with a proximal end 32, a distal end 34, and a longitudinal axis 36. The ram body distal end 34 includes a punch 38. The ram body proximal end 32 is coupled to the drive mechanism 14. The drive mechanism 14 provides a reciprocal motion to the ram body 30 causing the ram body 30 to move back and forth along its longitudinal axis 36. That is, the ram body 30 is structured to reciprocate between a first, retracted position and a second, extended position. In the first, retracted position, the ram body 30 is spaced from the die pack 16. In the second, extended position, the ram body 30 extends through the die pack 16. Thus, the reciprocating ram 12 advances forward (to the left as shown) passing through the redraw sleeve 40 and engaging the cup 2. The cup 2 is moved through the redraw die 42 and a number of ironing dies (not shown) within the die pack 16. The cup 2 is converted into a can body 3 within the die pack 16 and then removed therefrom. It is understood that, as used herein, a "cycle" means the cycle of the ram 12 which begins with the ram 12 in the first, retracted position.

Figure 2:
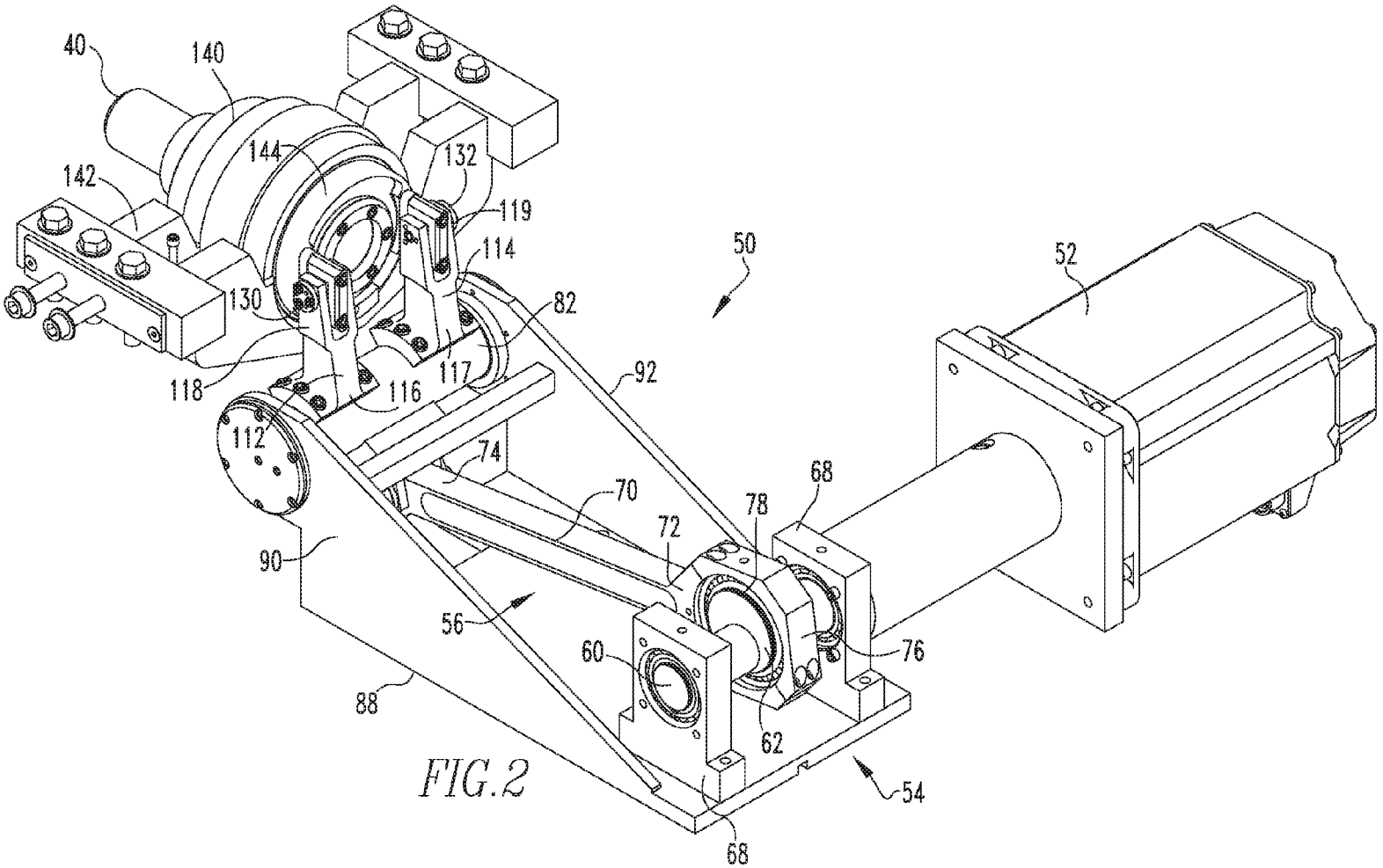
FIG. 2 is an isometric view of a redraw sleeve actuator.
Figure 3:
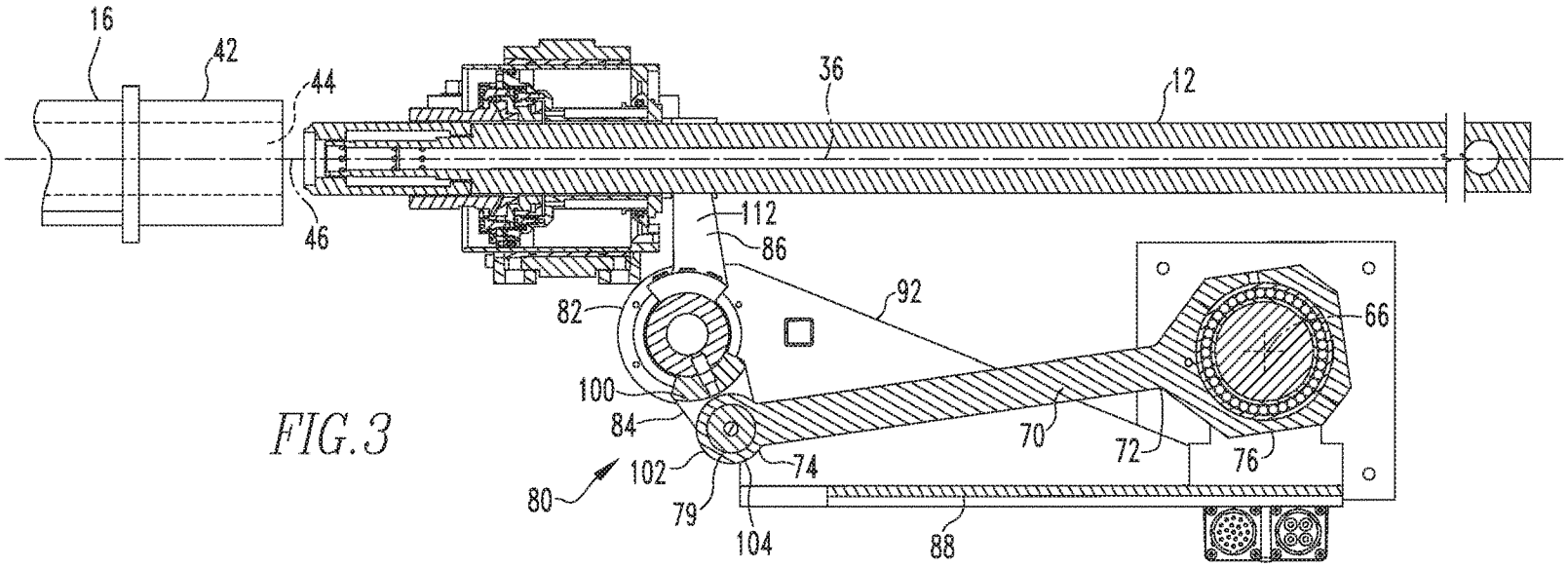
FIG. 3 is a cross-sectional view of a redraw sleeve and redraw sleeve actuator.

As shown in FIGS. 2 and 3, the redraw assembly 18 includes a movable redraw sleeve 40 and a redraw die 42 (FIG. 3). The redraw die 42 is disposed within the die pack 16 adjacent the redraw sleeve 40. That is, the redraw die 42 is the first die in the die pack 16. The redraw die 42 has a circular opening 44 with a central axis 46 (FIG. 3). The ram longitudinal axis 36 is substantially aligned, meaning substantially on the same line, with the redraw die central axis 46. The redraw die circular opening 44 has a smaller diameter than the cup 2. The cup 2 is clamped in place by the redraw sleeve 40.

That is, the redraw sleeve 40 is a hollow circular tube with an outer diameter sized to fit within the cup 2 enclosed space. The redraw sleeve 40 inner diameter is sized to allow the ram body 30 to pass therethrough. That is, the radius of the ram body 30, and more specifically the punch 38, is smaller than the redraw sleeve 40 inner diameter by a distance substantially equal to the thickness of the material forming the cup 2. Thus, as the ram body 30, and more specifically the punch 38, forces the cup 2 through the redraw sleeve 40, the cup 2 is elongated and resized to have a smaller diameter; the cup 2 wall thickness, however, remains substantially unchanged.

The redraw sleeve 40 is structured to move between a first position, wherein the movable redraw sleeve 40 is spaced from the redraw die 42, and a second position, wherein the movable redraw sleeve 40 is disposed immediately adjacent the redraw die 42. In the second position, the redraw sleeve 40 biases, i.e., clamps, the cup 2, and more specifically the cup bottom, against the redraw die 42. The cup 2 is further positioned so that the center of the cup 2 is disposed substantially on the redraw die central axis 46. The redraw sleeve 40 is moved between the first and second positions by an actuator assembly 50.

Figure 4:
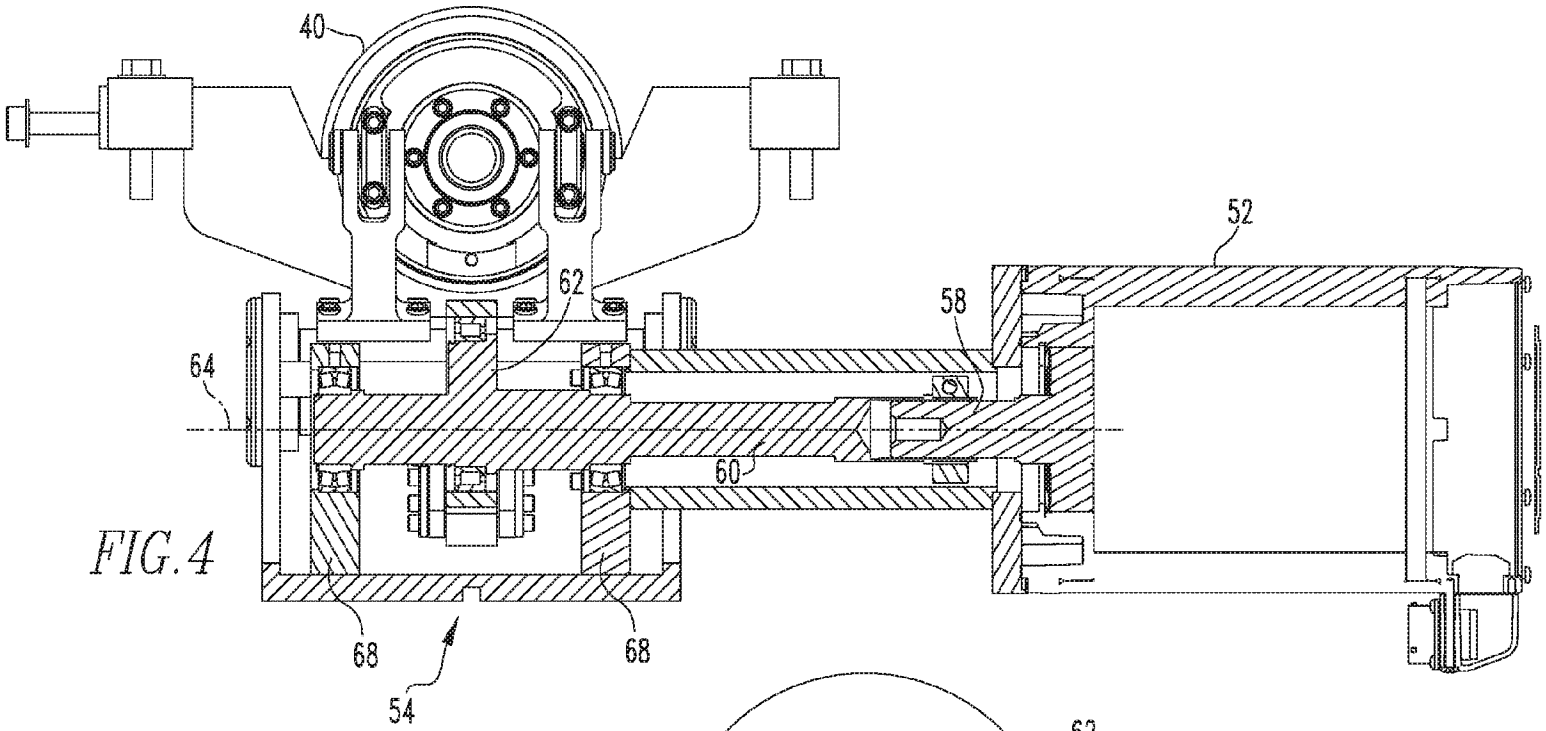
FIG. 4 is a cross-sectional view of a redraw sleeve actuator.

As shown in FIG. 4, the actuator assembly 50 includes a servomotor 52, an eccentric journal assembly 54, and a connecting rod assembly 56. The servomotor 52 includes a rotating output shaft 58. The servomotor 52 produces a selectable rotational speed in the servomotor output shaft 58. That is, as used herein, a "selectable rotational speed" means that the speed of rotation of the servomotor output shaft 58 may be varied within a single rotation and, more specifically, the speed of rotation of the servomotor output shaft 58 may be varied within a single cycle. For example, the servomotor 52 has a maximum rotational speed of between about 700 rpm and 500 rpm, and, a minimum rotational speed of between about 250 rpm and 50 rpm. In another embodiment, the servomotor 52 has a maximum rotational speed of about 540 rpm and a minimum rotational speed of about 125 rpm. The use of the selectable rotational speed of the servomotor output shaft 58 is discussed below.

Figure 5:
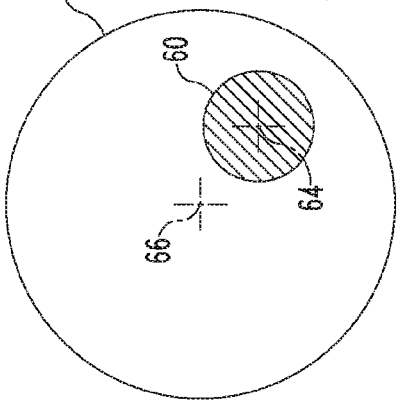
FIG. 5 is an axial view of an eccentric journal on a shaft.

The eccentric journal assembly 54 is coupled to the servomotor output shaft 58. More specifically, the eccentric journal assembly 54 includes a shaft 60 and an eccentric journal 62. The eccentric journal assembly shaft 60 has an axis of rotation 64. The eccentric journal 62 is substantially circular and, therefore, has a center 66. The eccentric journal 62 is coupled to the eccentric journal assembly shaft 60 with the eccentric journal center 66 spaced from the eccentric journal assembly shaft axis of rotation 64, as shown in FIG. 5. The journal assembly shaft 60 is supported by supports 68. That is, as is known, supports 68 include openings through which journal assembly shaft 60 extends. A bearing is, in an exemplary embodiment, disposed between the journal assembly shaft 60 and the supports 68.

Figure 6:
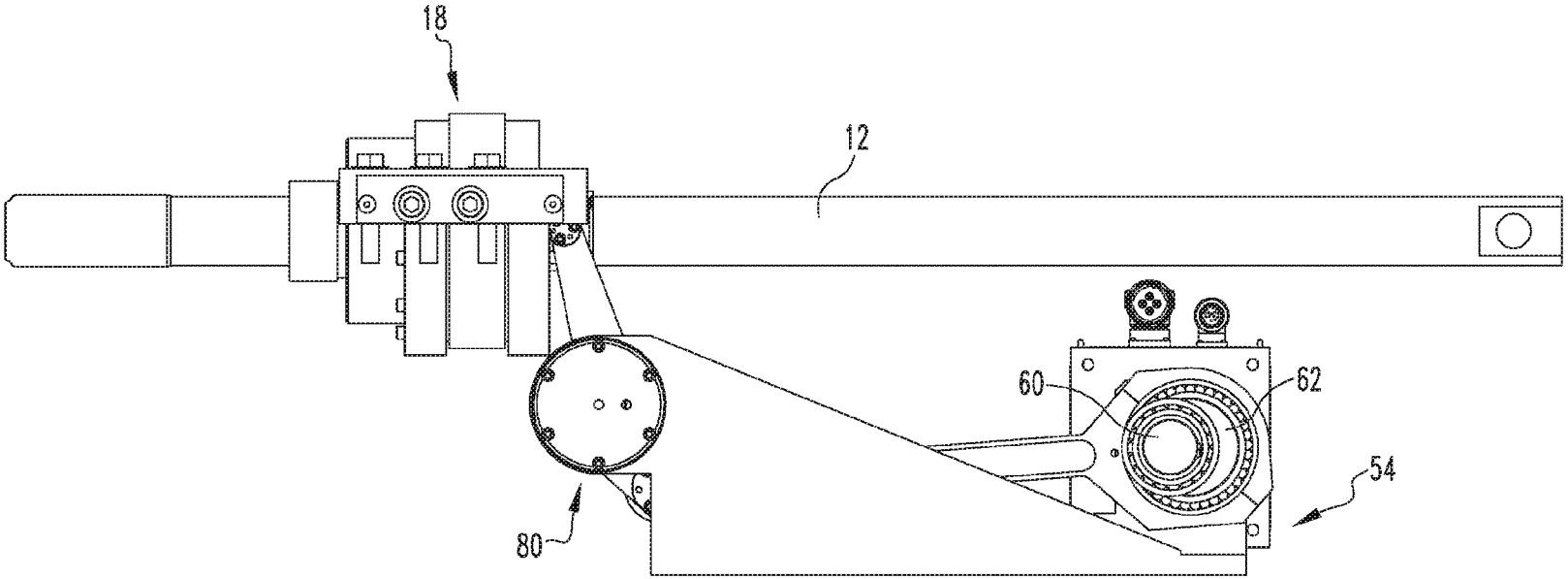
FIGS. 6-9 are partial cross-sectional side views of the redraw sleeve and redraw sleeve actuator with the eccentric journal assembly in different positions.
Figure 7:
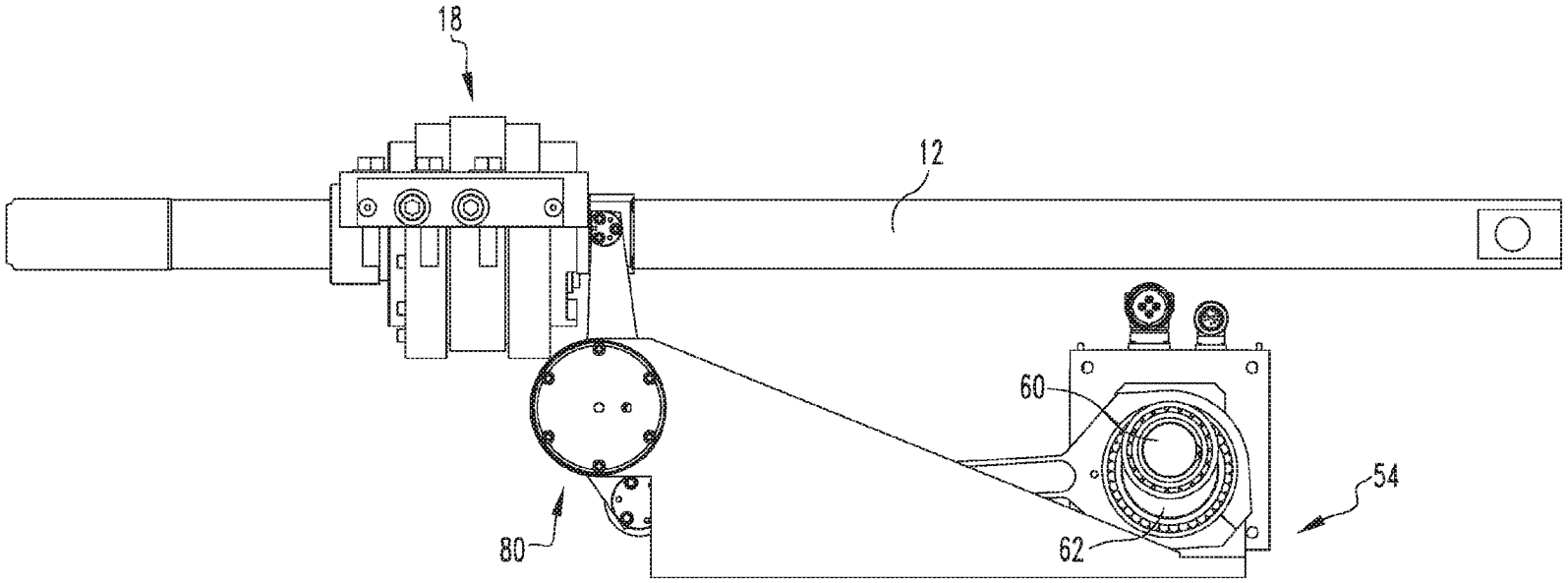
Figure 8:
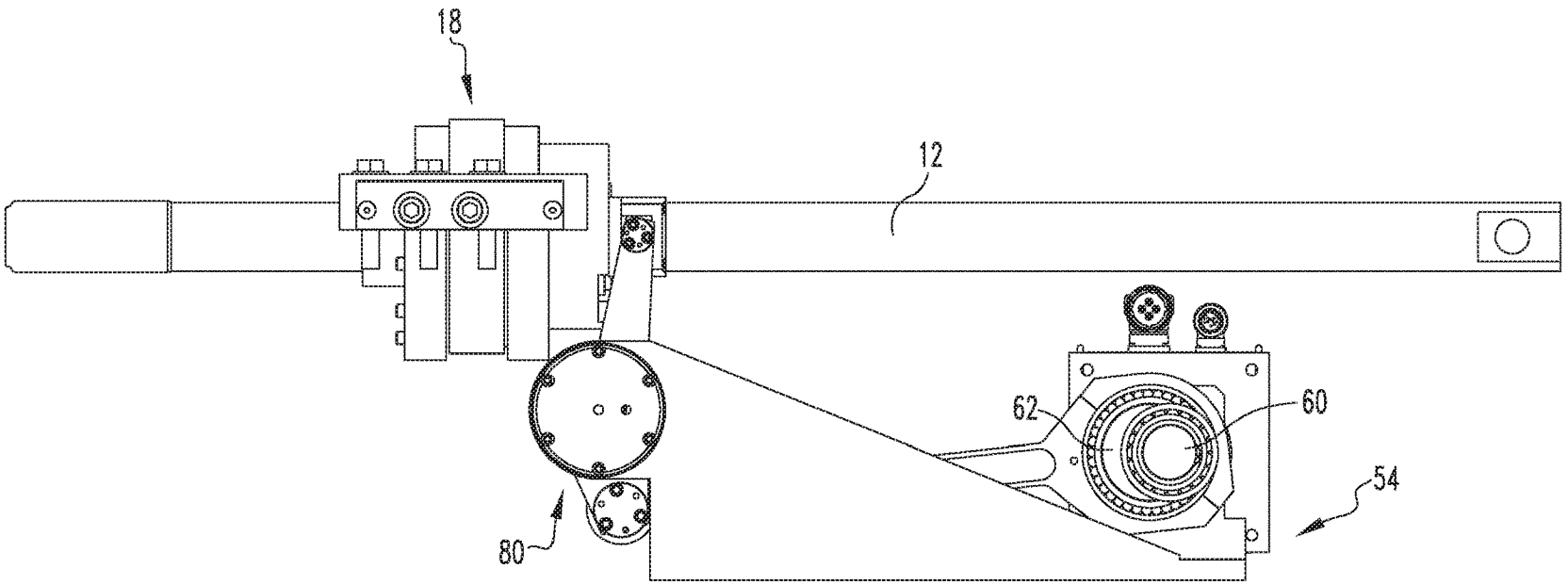
Figure 9:
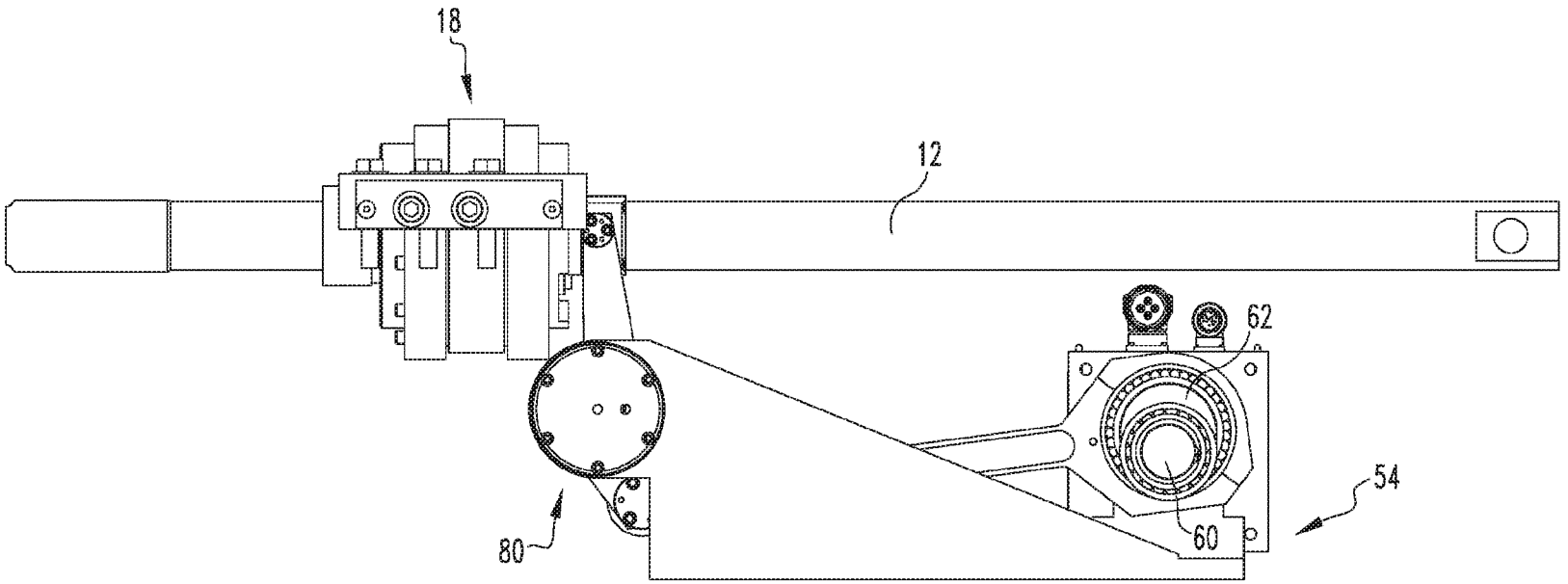

In this configuration, the eccentric journal 62 has a maximum radius from the eccentric journal assembly shaft axis of rotation 64. The location of the eccentric journal 62 maximum radius moves about the eccentric journal assembly shaft axis of rotation 64. Thus, there is a configuration wherein the eccentric journal 62 maximum radius is vertically above the eccentric journal assembly shaft axis of rotation 64 and another configuration wherein the eccentric journal 62 maximum radius is vertically below the eccentric journal assembly shaft axis of rotation 64. The eccentric journal assembly 54 is at least horizontally spaced from the redraw sleeve 40. Thus, there is a configuration wherein the eccentric journal 62 maximum radius is disposed at a location farthest from the redraw sleeve 40, as shown in FIG. 6. As used herein, this location is the eccentric journal assembly "first, rearward position." Conversely, there is a configuration wherein the eccentric journal 62 maximum radius is disposed at a location closest to the redraw sleeve 40, as shown in FIG. 8. As used herein, this location is the eccentric journal assembly "second, forward position." Further, as used herein, when the eccentric journal assembly 54 is in the "first, rearward position," the eccentric journal assembly 54 is in a "first, rearward position." Similarly, as used herein, when the eccentric journal assembly 54 is in the "second, forward position," the eccentric journal assembly 54 is in a "second, forward position." Finally, as shown in FIGS. 7 and 9, during the revolution of journal assembly shaft 60 the eccentric journal 62 maximum radius is also disposed either below the journal assembly shaft 60 (FIG. 7) or above the journal assembly shaft 60 (FIG. 9).

In the embodiment shown in FIG. 3, the connecting rod assembly 56 includes an elongated connecting rod 70 having a first end 72 and a second end 74. The connecting rod first end 72 includes a bearing assembly 76. The connecting rod first end bearing assembly 76 defines an opening 78 sized to correspond with the eccentric journal 62. Thus, the eccentric journal 62 may be disposed within the connecting rod first end bearing assembly opening 78. As the eccentric journal 62 rotates, bias is applied to the connecting rod first end bearing assembly 76. Thus, the connecting rod first end bearing assembly 76 is structured to engage the eccentric journal 62. The connecting rod second end 74, and therefore the connecting rod 70, is structured to be coupled to the redraw sleeve 40. More specifically, the connecting rod assembly 56 is structured to be coupled to an oscillating shaft assembly 80, described below, which is further coupled to the redraw sleeve 40. The connecting rod second end 74 includes a rotational coupling 79, as discussed below.

As noted above, the ram 12 travels through the redraw sleeve 40. As such, the actuator assembly 50 cannot be disposed along the path of travel for the ram 12. Thus, the actuator assembly 50 may include an oscillating shaft assembly 80 that is coupled to both the redraw sleeve 40 and the connecting rod assembly 56. Movement of the connecting rod assembly 56 causes the oscillating shaft assembly 80 to oscillate which, in turn, moves the redraw sleeve 40 between its first and second positions. The oscillating shaft assembly 80 includes a pivot shaft 82, a drive arm 84, a pivot arm assembly 86, and a base 88. As shown in FIG. 2, the eccentric journal assembly 54 may be coupled, or directly coupled, to the base 88. In one embodiment, the base 88 includes two upwardly extending and spaced flanges 90, 92 (FIG. 2). The pivot shaft 82 is rotatably coupled to the base 88, e.g., between the spaced flanges 90, 92.

Before discussing the drive arm it is noted that, as used herein, a "rotational coupling" is one element of a "rotational coupling assembly." As used herein, a "rotational coupling assembly" is an assembly that allows components to be rotatably coupled. For example, a "rotational coupling assembly" may include one component defining a circular opening and the other component being a circular rod. When the circular rod is disposed in the circular opening, the two components are rotatably coupled. As shown in the Figures, "rotational couplings" are either components defining a circular opening or circular rods. It is understood, however, that the location of these components may be reversed and still create a "rotational coupling assembly." Thus, hereinafter, the elements of a "rotational coupling assembly" shall be identified as a "rotational coupling" without identifying the shape of a specific component.

The drive arm 84 includes a first, proximal end 100 and a second, distal end 102. The drive arm first end 100 is coupled, and in one embodiment fixed, to the pivot shaft 82. The drive arm second end 102 has a rotational coupling 104. The drive arm second end rotational coupling 104 is rotatably coupled to the connecting rod second end rotational coupling 79. As shown, in one embodiment, the drive arm 84 is coupled to the lower side of the pivot shaft 82, generally opposite the pivot arm assembly 86.

As shown in FIGS. 2 and 3, the pivot arm assembly 86 is disposed near the top of the pivot shaft 82. The pivot arm assembly 86 includes at least a first elongated pivot arm 112 and, as shown, a second pivot arm 114. The first and second pivot arms 112, 114 form a yoke, as discussed below. The first pivot arm has a first end 116 and a second end 118. The second pivot arm 114 has a first end 117 and a second end 119. Each pivot arm first end 116, 117 is coupled, and in one embodiment fixed, to the pivot shaft 82. Each pivot arm 112, 114 extends substantially upwardly. Each pivot arm second end 118, 119 includes a rotational coupling 130, 132, respectively. Each pivot arm second end rotational coupling 130, 132 is structured to be coupled to the movable redraw sleeve 40.

When assembled, the servomotor output shaft 58 is coupled, and in one embodiment fixed, to the eccentric journal assembly shaft 60. Thus, the eccentric journal assembly shaft 60 rotates at the same speed as the servomotor output shaft 58. Rotation of the eccentric journal assembly shaft 60 causes the eccentric journal 62 to rotate through the first, rearward position and the second, forward position. The connecting rod first end bearing assembly 76 is disposed about the eccentric journal 62 and the connecting rod 70 extends toward the oscillating shaft assembly 80. The connecting rod second end 74, and more specifically the connecting rod second end rotational coupling 79, is rotatably coupled to the drive arm second end 102, and more specifically to the drive arm second end rotational coupling 104.

In this configuration, rotation of the servomotor output shaft 58 causes the eccentric journal 62 to rotate through the first, rearward position and the second, forward position. This shifting of the offset eccentric journal 62 causes the connecting rod 70 to move between a first, rearward position and a second, forward position corresponding to the eccentric journal assembly first and second positions. That is, the connecting rod 70 is disposed either close to, or spaced from, the oscillating shaft assembly 80 and the redraw sleeve 40. More specifically, as the eccentric journal 62 moves from its first, rearward position toward its second, forward position, the connecting rod 70 moves toward the oscillating shaft assembly 80 and the redraw sleeve 40. As the eccentric journal 62 moves from its second, forward position toward its first, rearward position, the connecting rod 70 moves away from the oscillating shaft assembly 80 and the redraw sleeve 40. As noted above, the eccentric journal 62 may be disposed above or below the eccentric journal assembly shaft 60. As the connecting rod 70 extends toward the oscillating shaft assembly 80, the vertical offset of the eccentric journal 62 causes the connecting rod first end 72 to move vertically, but does not substantially affect the position of the connecting rod 70 relative to the oscillating shaft assembly 80 and the redraw sleeve 40.

As the connecting rod 70 moves toward and away from the oscillating shaft assembly 80, the pivot shaft 82 moves, and more specifically rocks, between a first position and a second position. Thus, the upwardly extending first and second pivot arms 112, 114 rock between a first, rearward position and a second, forward position. The first and second pivot arms 112, 114 first and second positions correspond to the eccentric journal 62 first and second positions. That is, when the eccentric journal 62 is in its first position, the first and second pivot arms 112, 114 are in their first position, and, when the eccentric journal 62 is in its second position, the first and second pivot arms 112, 114 are in their second position. Thus, the first and second pivot arms 112, 114 move generally forward and back at a speed corresponding to the speed of the servomotor 52.

The first and second pivot arms 112, 114 are coupled to the redraw sleeve 40. Thus, the redraw sleeve 40 moves generally forward and back at a speed corresponding to the speed of the servomotor 52. That is, the redraw sleeve 40 moves between its first and second positions at a speed corresponding to the speed of the servomotor 52. As noted above, the redraw sleeve 40 only needs to be in the second, forward position while clamping the cup 2. Thus, it is desirable to move the redraw sleeve 40 toward its first, rearward position as soon as the ram 12 passes therethrough. The redraw sleeve 40, however, must move into the second, forward position as soon as a new cup 2 is positioned in front of the die pack 16. To accomplish this, the servomotor 52 must operate at different speeds during different parts of the cycle. Generally, the redraw sleeve 40, and therefore the eccentric journal 62, must move faster when moving between the first, rearward position and the second, forward position, and slower when moving between the second, forward position and the first, rearward position.

The change in the speed of the servomotor 52, in one embodiment, occurs just before the eccentric journal 62 is in either of the first or second positions. That is, the eccentric journal 62 is disposed in an "acceleration position" just before it enters the first, rearward position. As used herein, the "acceleration position" is the position of the eccentric journal 62 just as it starts to accelerate. The exact location of the acceleration position depends upon many factors such as, but not limited to, the size of the cup 2, the length of the stroke of the ram 12, the diameter of the punch 38, the retract position of the punch 38 to the redraw die 42 and, the speed of the cup 2 feeding into position. Further, the eccentric journal 62 is disposed in n "deceleration position" just before it enters the second, forward position. As used herein, the "deceleration position" is the position of the eccentric journal 62 just as it starts to decelerate. The exact location of the deceleration position also depends upon factors set forth above. By selecting the speed of the servomotor 52, the positioning of the redraw sleeve 40 may be timed so as to move the redraw sleeve 40 into the proper position for each cycle of the ram 12.

As noted above, the redraw sleeve 40 must dwell in the forward position as the ram 12 passes therethrough and engages the clamped cup 2. As the components of the actuator assembly 50 have fixed dimensions, and as existing servomotors 52 may not be stopped and started rapidly enough, the redraw sleeve 40 is, in one embodiment, a collapsing redraw sleeve 140. A collapsing redraw sleeve 140 includes a stationary slide housing 142 and a collapsing redraw cylinder 144. The collapsing redraw cylinder 144 is slidably disposed in the stationary slide housing 142 and is structured to move between a first, retracted position and a second, extended position. Further, the collapsing redraw cylinder 144 is structured to change between a first elongated configuration and a second collapsed configuration.

In operation, when the collapsing redraw sleeve 140 is moved toward the forward position, the collapsing redraw sleeve 140 engages, i.e., clamps the cup 2 just prior to the eccentric journal 62 reaching the second, forward position. As the eccentric journal 62 moves into the second, forward position, the collapsing redraw cylinder 144 collapses, i.e., the collapsing redraw cylinder 144 changes between the first elongated configuration to the second collapsed configuration. As the eccentric journal 62 moves past the second, forward position, the collapsing redraw cylinder 144 changes between the second collapsed configuration and the first elongated configuration. In other words, the collapsing redraw cylinder 144 is structured to change between the first elongated configuration to the second collapsed configuration, and, then to change between the second collapsed configuration to the first elongated configuration, while the collapsing redraw cylinder 144 is in the second, extended position. Thus, the cup 2 remains clamped against the redraw die 42 before, during, and after the eccentric journal 62 is in the second, forward position. Thus, this configuration creates a dwell time where the collapsing redraw sleeve 140 is clamping the cup 2 while the rigid components of the actuator assembly 50 remain in motion. An example of a collapsing redraw cylinder 144 is disclosed in U.S. Pat. No. 4,581,915.

While specific embodiments of the invention have been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of invention which is to be given the full breadth of the claims appended and any and all equivalents thereof.

What is claimed is:

1. An actuator assembly for a redraw assembly, said actuator assembly comprising:

a servomotor including a rotating output shaft;

an eccentric journal assembly, said eccentric journal assembly coupled to said servomotor output shaft;

a connecting rod assembly including a connecting rod, said connecting rod coupled to said eccentric journal assembly;

wherein rotation of said servomotor output shaft causes said eccentric journal assembly to rotate between at least a first, rearward position and a second, forward position;

wherein said connecting rod moves between a first, rearward position and a second, forward position corresponding, respectively, to said eccentric journal assembly first position and said eccentric journal assembly second position;

wherein said connecting rod is structured to be coupled to a movable redraw sleeve; and wherein said servomotor produces a selectable rotational speed in said servomotor output shaft.

2. The actuator assembly of claim 1 wherein:

said eccentric journal assembly also rotates through an acceleration position and a deceleration position;

said acceleration position occurring just prior to said eccentric journal assembly's second, forward position; and said deceleration position occurring just prior to said eccentric journal assembly's first, rearward position.

3. The actuator assembly of claim 2 wherein:

said servomotor has a faster rotational speed when said eccentric journal assembly is moving between the first, rearward position and the second, forward position; and said servomotor has a slower rotational speed when said eccentric journal assembly is moving between the first, rearward position and the second, forward position.

4. The actuator assembly of claim 1 wherein:

said servomotor has a maximum rotational speed of between about 700 rpm and 500 rpm; and said servomotor has a minimum rotational speed of between about 250 rpm and 50 rpm.

5. The actuator assembly of claim 4 wherein:

said servomotor has a maximum rotational speed of about 540 rpm; and said servomotor has a minimum rotational speed of about 125 rpm.

6. The actuator assembly of claim 1 wherein:

said eccentric journal assembly includes a shaft and an eccentric journal;

said eccentric journal assembly shaft having an axis of rotation;

said eccentric journal being substantially circular; and wherein eccentric journal is coupled to said eccentric journal assembly shaft with the center of said eccentric journal spaced from said eccentric journal assembly shaft axis of rotation.

7. The actuator assembly of claim 6 wherein:

said connecting rod has a first end and a second end;

said connecting rod first end includes a bearing assembly, said connecting rod first end bearing assembly structured to engage said eccentric journal; and said connecting rod second end structured to be coupled to a movable redraw sleeve.

8. The actuator assembly of claim 7 wherein:

said servomotor has a faster rotational speed when said eccentric journal assembly is moving between the first, rearward position and the second, forward position;

said servomotor has a slower rotational speed when said eccentric journal assembly is moving between the first, rearward position and the second, forward position;

wherein, said connecting rod moves at a faster speed when said eccentric journal assembly is moving between the first, rearward position and the second, forward position;

wherein, said connecting rod moves at a slower speed when said eccentric journal assembly is moving between the first, rearward position and the second, forward position;

wherein, said movable redraw sleeve moves at a faster speed when said eccentric journal assembly is moving between the first, rearward position and the second, forward position; and wherein, said movable redraw sleeve moves at a slower speed when said eccentric journal assembly is moving between the first, rearward position and the second, forward position.

9. The actuator assembly of claim 1 wherein:

said servomotor has a faster rotational speed when said eccentric journal assembly is moving between the first, rearward position and the second, forward position; and said servomotor has a slower rotational speed when said eccentric journal assembly is moving between the first, rearward position and the second, forward position.

10. The actuator assembly of claim 1 wherein:

said movable redraw sleeve moves at a faster speed when said eccentric journal assembly is moving between the first, rearward position and the second, forward position; and said movable redraw sleeve moves at a slower speed when said eccentric journal assembly is moving between the first, rearward position and the second, forward position.

11. A redraw assembly comprising:

a movable redraw sleeve;

a redraw die;

said movable redraw sleeve structured to move between a first position, wherein said movable redraw sleeve is spaced from said redraw die, and a second position, wherein said movable redraw sleeve is disposed immediately adjacent said redraw die;

an actuator assembly for a redraw assembly including a servomotor, an eccentric journal assembly, and a connecting rod assembly;

said servomotor including a rotating output shaft;

said eccentric journal assembly coupled to said servomotor output shaft;

said connecting rod assembly including a connecting rod, said connecting rod coupled to said eccentric journal assembly;

wherein rotation of said servomotor output shaft causes said eccentric journal assembly to rotate between at least a first, rearward position and a second, forward position;

wherein said connecting rod moves between a first, rearward position and a second, forward position corresponding, respectively, to said eccentric journal assembly first position and said eccentric journal assembly second positions;

wherein said connecting rod is coupled to said movable redraw sleeve; and wherein said servomotor produces a selectable rotational speed in said servomotor output shaft.

12. The redraw assembly of claim 11 wherein:

said eccentric journal assembly also rotates through an acceleration position and a deceleration position;

said acceleration position occurring just prior to said eccentric journal assembly's second, forward position; and said deceleration position occurring just prior to said eccentric journal assembly's first, rearward position.

13. The redraw assembly of claim 11 wherein:

said servomotor has a faster rotational speed when said eccentric journal assembly is moving between the first, rearward position and the second, forward position; and said servomotor has a slower rotational speed when said eccentric journal assembly is moving between the first, rearward position and the second, forward position.

14. The redraw assembly of claim 11 wherein:

said servomotor has a maximum rotational speed of between about 700 rpm and 500 rpm; and said servomotor has a minimum rotational speed of between about 250 rpm and 50 rpm.

15. The redraw assembly of claim 14 wherein:

said servomotor has a maximum rotational speed of about 540 rpm; and said servomotor has a minimum rotational speed of about 125 rpm.

16. The redraw assembly of claim 11 wherein:

said eccentric journal assembly includes a shaft and an eccentric journal;

said eccentric journal assembly shaft having an axis of rotation;

said eccentric journal being substantially circular; and wherein eccentric journal is coupled to said eccentric journal assembly shaft with the center of said eccentric journal spaced from said eccentric journal assembly shaft axis of rotation.

17. The redraw assembly of claim 16 wherein:

said connecting rod has a first end and a second end;

said connecting rod first end includes a bearing assembly, said connecting rod first end bearing assembly structured to engage said eccentric journal; and said connecting rod second end is coupled to said movable redraw sleeve.

18. The redraw assembly of claim 17 wherein:

said servomotor has a faster rotational speed when said eccentric journal assembly is moving between the first, rearward position and the second, forward position;

said servomotor has a slower rotational speed when said eccentric journal assembly is moving between the first, rearward position and the second, forward position;

wherein, said connecting rod moves at a faster speed when said eccentric journal assembly is moving between the first, rearward position and the second, forward position;

wherein, said connecting rod moves at a slower speed when said eccentric journal assembly is moving between the first, rearward position and the second, forward position;

wherein, said movable redraw sleeve moves at a faster speed when said eccentric journal assembly is moving between the first, rearward position and the second, forward position; and wherein, said movable redraw sleeve moves at a slower speed when said eccentric journal assembly is moving between the first, rearward position and the second, forward position.

19. The redraw assembly of claim 11 wherein:

said servomotor has a faster rotational speed when said eccentric journal assembly is moving between the first, rearward position and the second, forward position; and said servomotor has a slower rotational speed when said eccentric journal assembly is moving between the first, rearward position and the second, forward position.

20. The redraw assembly of claim 11 wherein:

said movable redraw sleeve moves at a faster speed when said eccentric journal assembly is moving between the first, rearward position and the second, forward position; and said movable redraw sleeve moves at a slower speed when said eccentric journal assembly is moving between the first, rearward position and the second, forward position.

* * * * *